US010940495B2

(12) United States Patent
Westgate et al.

(10) Patent No.: US 10,940,495 B2
(45) Date of Patent: Mar. 9, 2021

(54) SPRAY HEAD

(71) Applicant: Kohler Mira Limited, Cheltenham (GB)

(72) Inventors: Simon Westgate, Cheltenham (GB); Andrew Warner, Cheltenham (GB)

(73) Assignee: KOHLER MIRA LIMITED

( * ) Notice: Subject to any disclaimer, the term of this patent is extended or adjusted under 35 U.S.C. 154(b) by 170 days.

(21) Appl. No.: 16/082,499

(22) PCT Filed: Jan. 11, 2017

(86) PCT No.: PCT/GB2017/050055
§ 371 (c)(1),
(2) Date: Sep. 5, 2018

(87) PCT Pub. No.: WO2017/153709
PCT Pub. Date: Sep. 14, 2017

(65) Prior Publication Data

US 2019/0091705 A1 Mar. 28, 2019

(30) Foreign Application Priority Data

Mar. 9, 2016 (GB) ..... 1604071

(51) Int. Cl.
*B05B 1/18* (2006.01)
*B05B 1/16* (2006.01)

(52) U.S. Cl.
CPC ..... *B05B 1/18* (2013.01); *B05B 1/16* (2013.01); *B05B 1/1627* (2013.01); *B05B 1/1636* (2013.01); *B05B 1/1681* (2013.01)

(58) Field of Classification Search
CPC ..... B05B 1/18; B05B 1/1636; B05B 1/1627; B05B 1/1681; B05B 1/16
(Continued)

(56) References Cited

U.S. PATENT DOCUMENTS 5,201,468 A * 4/1993 Freier ..... B05B 1/1654 239/449
5,398,872 A 3/1995 Joubran
(Continued)

FOREIGN PATENT DOCUMENTS

CN 2764490 3/2006
CN 201419131 3/2010
(Continued)

OTHER PUBLICATIONS

International Search Report dated Apr. 11, 2017; 3 pgs.

*Primary Examiner* — Steven J Ganey
(74) *Attorney, Agent, or Firm* — Foley & Lardner LLP

(57) ABSTRACT

A spray assembly (110) for a spray head (200) which is arranged, in use, to adjust a spray pattern of fluid includes a spray plate (118) with a plurality of holes (132, 134) therethrough, and a control member (116) rotatable relative to the spray plate (118). In use, the orientation of the spray plate (118) is fixed and rotation of the control member (116) causes fluid to be directed to different groups of the plurality of holes (132, 134) through the spray plate (118). The spray assembly (110) further comprises at least one flow control opening (152) provided in a flow control plate (124) driven by rotation of the control member (116). The flow control opening (152) is arranged, in use, to be moved in response to rotation of the control member (116). The flow control plate (124) has teeth (142) on its outer circumference which interlock with teeth (146) on an outer circumference of an idler gear (148). The teeth (146) of the idler gear (148) interlock with teeth (144) on an inner circumference of the control member (116).

18 Claims, 14 Drawing Sheets

(58) Field of Classification Search
USPC ..... 239/390, 396, 397, 443–449, 525, 530, 239/558, 559, 560, 561, 602, DIG. 19
See application file for complete search history.

(56) References Cited

U.S. PATENT DOCUMENTS

| | | | | |
|---|---|---|---|---|
| 5,765,760 | A | 6/1998 | Kuo | |
| 5,862,985 | A * | 1/1999 | Neibrook | B05B 1/1636 239/444 |
| 6,223,998 | B1 * | 5/2001 | Heitzman | B05B 3/04 239/602 |
| 6,736,336 | B2 * | 5/2004 | Wong | B05B 1/1654 239/446 |
| 8,876,023 | B2 * | 11/2014 | Peel | B05B 1/1654 239/447 |
| 2005/0061896 | A1 | 3/2005 | Luettgen | |
| 2013/0001324 | A1 | 1/2013 | Miedzius | |

FOREIGN PATENT DOCUMENTS

| | | |
|---|---|---|
| GB | 1468961 | 3/1977 |
| WO | WO-2011/076077 | 6/2011 |

* cited by examiner

SPRAY HEAD

CROSS-REFERENCE TO RELATED PATENT APPLICATIONS

This application is a U.S. National Stage of International Application No. PCT/GB2017/050055, filed Jan. 11, 2017, which claims priority to and the benefit of United Kingdom Patent Application 1604071.9, filed Mar. 9, 2016, each of which is incorporated herein by reference in its entirety.

BACKGROUND

This invention relates to a spray head. More particularly it concerns spray heads in which the water spray from the shower head can be altered. The invention may have particular application for shower heads but it need not be limited to this use.

For convenience, the invention is discussed primarily in relation to shower heads and the flow of water therethrough. The skilled person will appreciate that other applications of the spray control mechanism are possible, such as for taps or hoses, and that other fluids may be used in place of water.

Prior art adjustable shower heads often have a spray plate which can be rotated to select between different sets of spray holes for altering the water spray from the shower head. These shower heads can be difficult to use, especially for elderly or disabled users with reduced manual dexterity and/or eyesight.

There is therefore a need for a spray head which overcomes or mitigates this problem.

SUMMARY

According to a first aspect of the invention, there is provided a spray assembly suitable for use in a spray head. The spray assembly is arranged, in use, to adjust a spray pattern of a fluid.

The spray assembly preferably comprises a spray plate with a plurality of holes therethrough. The plurality of holes may be arranged in different groups.

The spray assembly preferably further comprises a control member rotatable relative to the spray plate. Rotation of the control member may cause fluid to be directed to different groups of the plurality of holes through the spray plate.

The orientation of the spray plate may be fixed. In this way the spray plate does not move when changing the spray mode. The spray plate may be fixed relative to a spray head provided with the spray assembly.

The spray assembly may further comprise at least one flow control opening arranged, in use, to be moved in response to rotation of the control member.

In some embodiments the at least one flow control opening may be provided in a flow control plate driven directly or indirectly by rotation of the control member.

In some embodiments the flow control plate may have teeth on its outer circumference, the teeth being arranged to allow rotational movement to be transferred from the control member to the flow control plate. The teeth may go all the way round the outer circumference of the flow control plate. The teeth may be arranged to cooperate with, or mesh (i.e. interlock) with, teeth on one or more other components such that movement of the flow control plate can be driven directly or indirectly by rotation of the control member.

The flow control plate may take the form of a gear or cogwheel.

In some embodiments the flow control plate may have teeth on its outer circumference which interlock with teeth on an inner circumference of the control member. This is an example of direct drive of the flow control plate by rotation of the control member. The teeth of the flow control plate may be present all the way around the outer circumference of the flow control plate. The teeth of the control member may be present all the way around the inner circumference of the control member. Additionally, the teeth on each component may be evenly spaced around the circumference.

In some embodiments the flow control plate may have teeth on its outer circumference which interlock with teeth on an outer circumference of an idler gear, and wherein the teeth of the idler gear interlock with teeth on an inner circumference of the control member. This is an example of indirect drive of the flow control plate by rotation of the control member. The teeth of the flow control plate may be present all the way around the outer circumference of the flow control plate. The teeth of the idler gear may be present all the way around the inner circumference of the idler gear. Additionally, the teeth on each component may be evenly spaced around the circumference. The skilled person would appreciate that a plurality of idler gears or the likes may be used in some embodiments.

In some embodiments the at least one flow control opening may be provided in the control member.

The spray assembly may further comprise a diverter plate having diverter channels associated with different groups of the plurality of holes of the spray plate. The orientation of the diverter plate may be fixed with respect to the spray plate.

The diverter channels may communicate with the at least one flow control opening according to the position of the flow control plate or the control member.

The at least one flow control opening may be arranged to be moved between a plurality of discrete positions. The at least one flow control opening may be arranged to align with a different one of the plurality of channels in each discrete position.

In some embodiments, the diverter plate and spray plate may be provided in the form of a detachable spray cartridge.

In some embodiments, the spray plate may be detachable from the diverter plate.

In some embodiments the control member may comprises an annular ring.

The ring may extend around an outer perimeter of the spray assembly.

The ring may be of a colour contrasting to a colour of an adjacent portion of the spray assembly.

The control ring may comprise elastomer or polymer. The control ring may comprise rubber.

The control ring may comprise foam elastomer or polymer.

The control ring comprises one or more protrusions around its circumference.

The control ring may have a textured surface around its circumference.

In another aspect the invention provides a spray head comprising a spray assembly according to preceding aspect of the invention arranged, in use, to adjust a spray pattern of fluid from the spray head.

The spray head may have some or all of the optional features described above in relation to the preceding aspect of the invention.

The spray head may comprise a shower head. The shower head may comprise a shower handset. The shower head may comprise a fixed shower head.

In another aspect the invention provides a method of adjusting the spray pattern of fluid from a shower head comprising: providing a shower head comprising a control member and a spray plate; positioning the shower head adjacent to a surface; and moving the shower head relative to the surface such that the control member rotates by contact with the surface without rotating the spray plate.

The shower head may have some or all of the features described above with respect to the preceding aspects of the invention.

The control member may be coaxial with an annular portion of the shower head.

The control member may have a diameter greater than that of the annular portion of the shower head, such that the control member protrudes from the annular portion of the shower head.

BRIEF DESCRIPTION OF THE DRAWINGS

There now follows by way of example only a detailed description of embodiments of the present invention with reference to the accompanying drawings in which.

DETAILED DESCRIPTION

Figure 1:
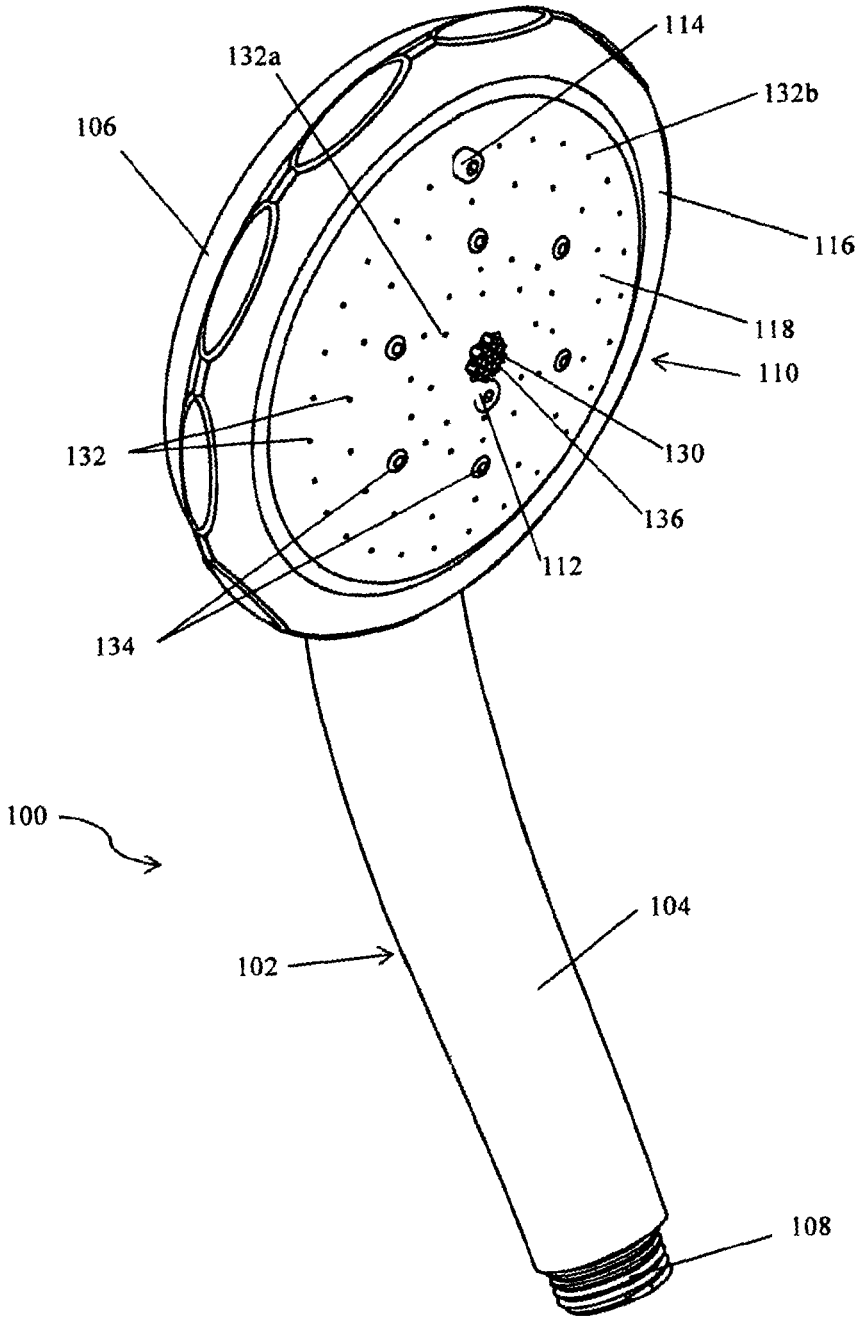
FIG. 1 shows a perspective view of a shower handset according to an embodiment.
Figure 2:
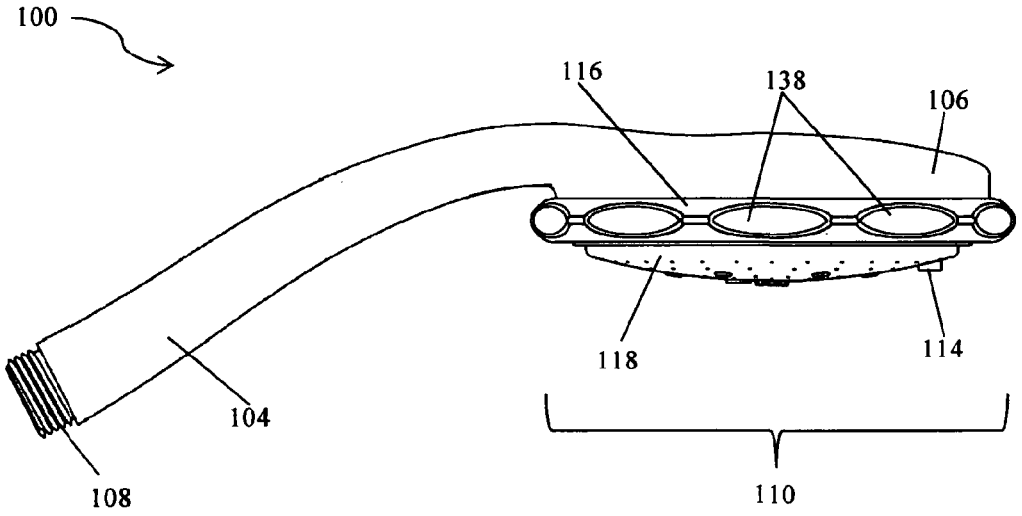
FIG. 2 shows a side view of the shower handset shown in FIG. 1.
Figure 3:
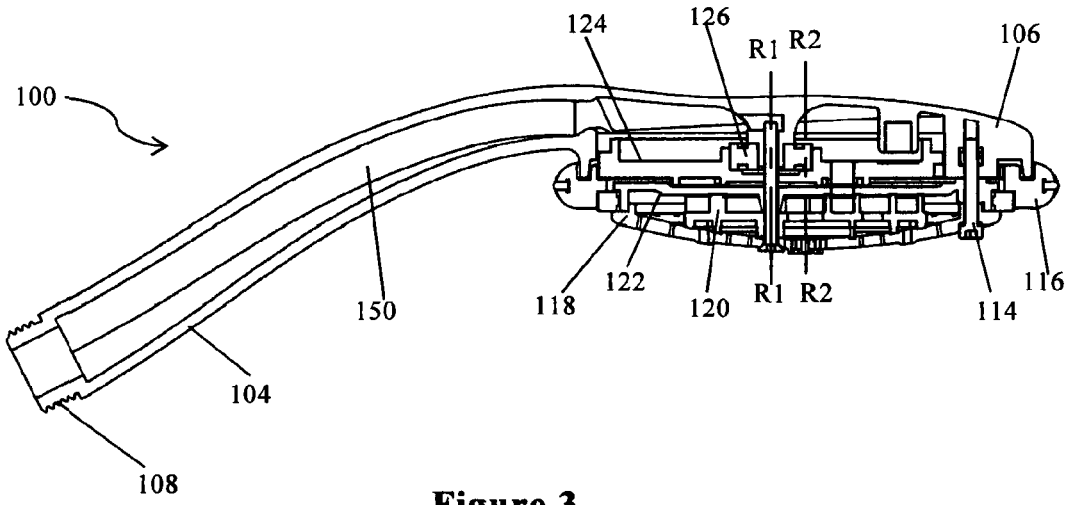
FIG. 3 shows a sectional view of the shower handset shown in FIGS. 1 and 2.
Figure 4:
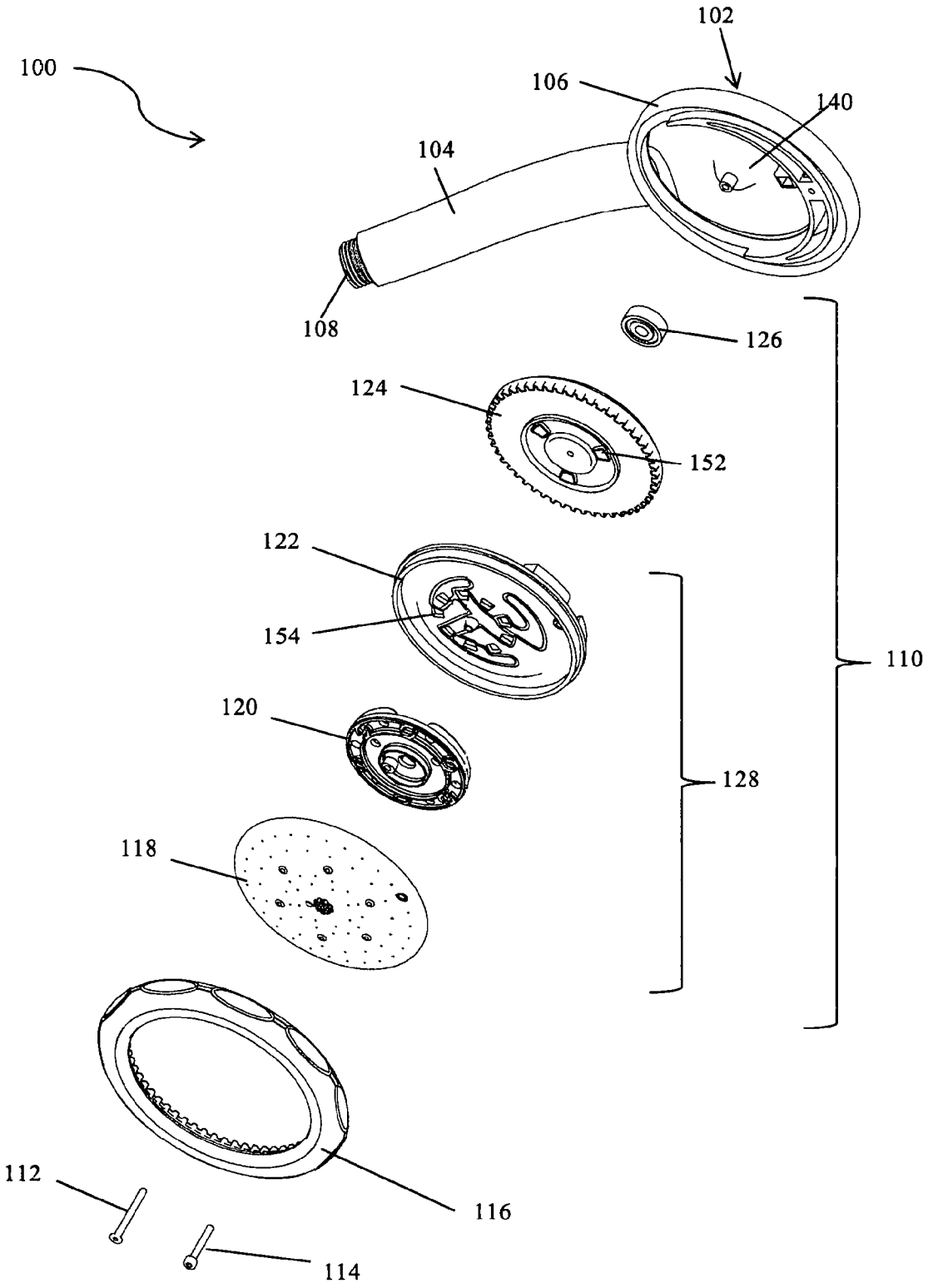
FIG. 4 shows an exploded view of shower handset shown in FIGS. 1 to 3.
Figure 5:
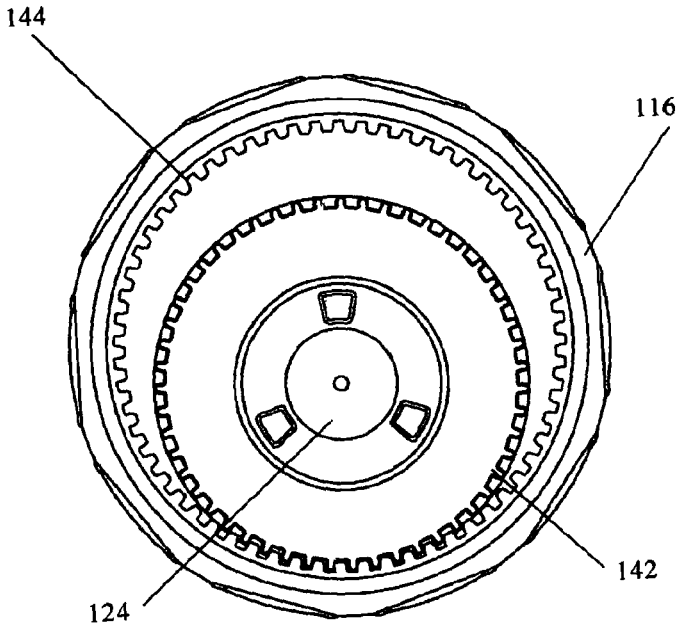
FIG. 5 shows a detail of the spray control mechanism of the shower handset shown in FIGS. 1 to 4.
Figure 6:
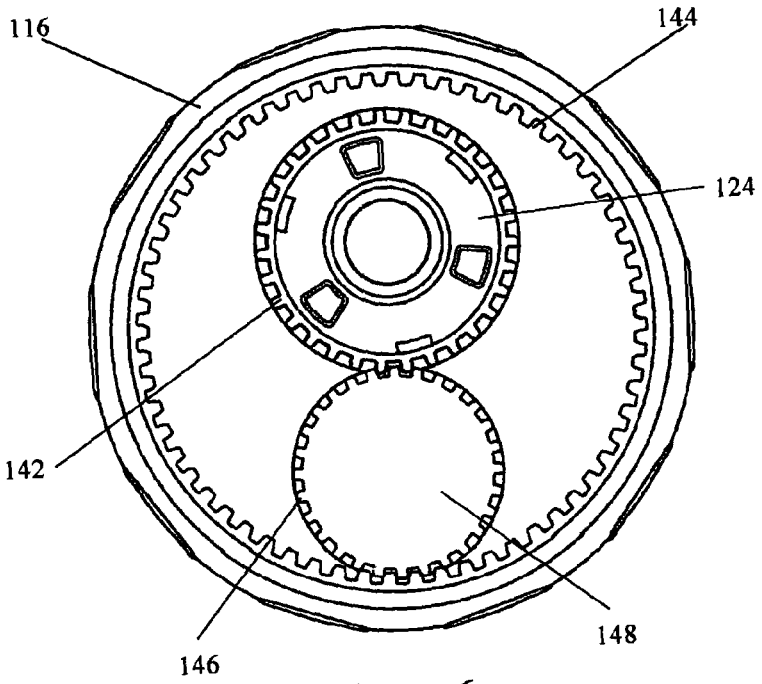
FIG. 6 shows a modification to the spray control mechanism shown in FIG. 5.

Referring to FIGS. 1 to 8 of the accompanying drawings, a shower handset 100 according to an embodiment of the invention is shown. The shower handset 100 comprises a body 102 having a grip or stem portion 104 and a head portion 106. In use, the stem portion 104 may be connected to a water supply such as a hose (not shown) connected via a connector 108. A spray assembly 110 is attached to the head portion 106 and releasably secured by screws 112, 114. In use, water delivered to the spray assembly 110 through the body 102 is discharged to form a spray pattern.

The spray assembly comprises a control member 116, a spray plate 118, a baffle 120, a diverter plate 122, a flow control plate 124 and a bearing bush 126. The spray plate 118, baffle 120 and diverter plate 122 may be combined to form a spray cartridge 128. The spray cartridge 128 is preferably detachable and may be replaced allowing the handset 100 to be customised by selecting and fitting spray cartridges 128 providing different spray patterns. In other embodiments, the spray cartridge 128 may be configured such that the spray plate 118 and baffle 120 can be removed and replaced for changing spray modes without removal of the whole cartridge. In further embodiments, the spray cartridge 128 may be configured such that the spray plate 118 can be removed and replaced for changing spray modes without removal of the whole cartridge.

The spray plate 118 comprises a central hole 130, a first set of multiple holes 132, and a second set of multiple holes 134 therethrough. In this embodiment, the central hole 130 is provided with a mesh 136 that, in use, produces a fine spray pattern. Also in this embodiment the first set of multiple holes 132 is configured in annular inner and outer arrays 132*a*, 132*b* around the central hole 130. Also in this embodiment, the second set of multiple holes 134 is arranged in an annular array 134*a* disposed between the inner and outer arrays 132*a*, 132*b* of the first set. The skilled person would understand that different numbers, sizes, shapes and configurations of holes 130, 132, 134 may be provided in other embodiments. In use, water is ejected through the holes 130, 132, 134 in the spray plate 118 to produce different spray patterns and a user can select the holes 130, 132, 134 and thus the spray pattern produced by means of the control member 116 which can be rotated by the user to change the spray pattern.

In this embodiment, the control member is in the form of a ring 116 coaxial with the head portion 106 of the body 102 although this may not be essential. The control ring 116 may be provided in a contrasting colour to the body 102. This may facilitate identification of the control ring 116 by visually impaired users. The control ring 116 may comprise one or more protrusions 138 around its circumference. This may facilitate gripping of the control ring so as to facilitate turning of the control ring 116. The protrusions 138 may comprise rubber and/or may have a textured surface to increase friction and improve grip. In some embodiments, the protrusions 138 may comprise the same material as the control ring 116. In some embodiments, the protrusions 138 may be coloured to contrast with the body 102 whether or not the remainder of the control ring 116 is coloured to contrast with the body 102. The skilled person would understand that different numbers, sizes or shapes of protrusions 138 may be provided in other embodiments. In alternative embodiments, the control ring 116 may not have any protrusions 138, but may rather comprise a material which provides grip, for example an elastomer or polymer. The control ring 116 may comprise rubber or a foamed elastomer or polymer. Additionally or alternatively, the outer circumferential surface of the control ring 116 may be textured. The textured surface may serve to enhance grip. In other embodiments, the control ring 116 may have an actuator portion such as a tab or lever. The actuator portion may extend from the circumference of the control ring 116 so that a user may grip the actuator portion to rotate the control ring 116 to select different spray modes.

The control ring 116 is located between the head portion 106 of the body 102 and the spray cartridge 128. The control ring 116 may have a diameter slightly greater than that of the head portion 106 of the body 102 and the spray cartridge 128 so as to project outwards therefrom. This may allow the control ring 116 to be turned by running the control ring 116 along a surface, such as a bathroom wall or shower screen. This may facilitate changing the spray pattern by users who may find it difficult to grip and turn the control ring 116. In this embodiment, when the spray cartridge 128 is secured to body 102 of the handset 100, the spray cartridge 128 remains stationary with respect to the body of the shower handset 100. As a result, the spray plate 118 does not rotate when the control ring 116 is rotated to change the spray pattern.

The flow control plate 124 is located behind the spray cartridge 128. The flow control plate 124 is seated on the bearing bush 126 in a pocket 140 in the head portion 106 of the body 102 and is secured by the screw 112. The flow control plate 124 has teeth 142 around its outer circumference and the control ring 116 has teeth 144 around its inner circumference that engage with the teeth 142 on the flow control plate 124 such that the flow control plate 124 is rotatable relative to the body 102 of the handset 100 and the spray cartridge 128 in response to rotation of the control ring 116 to change the spray pattern. In this embodiment the axis of rotation R1 of the flow control plate 124 is offset from the axis of rotation R2 of the control ring 116 although this may not be essential. In an alternative arrangement shown in FIG. 6, the teeth 142, 144 engage with the teeth 146 on an idler 148 for transmitting rotation of the control ring 116 to the flow control plate 124 to change the spray pattern. In other arrangements (not shown), multiple idler gears may be used.

The body 102 of the handset 100 provides an internal passageway 150 for flow of water from the connector 108 to the pocket 140. The passageway 150 opens to the pocket 140 behind the flow control plate 124 and the flow control plate 124 has at least one opening or transfer port 152 for controlling flow of water to the spray cartridge 128. The diverter plate 122 of the spray cartridge 128 has a plurality of openings or transfer ports 154 for co-operating with the at least one transfer port 152 of the flow control plate 124 and the baffle 120 is configured in conjunction with the diverter plate 122 and spray plate 118 to control the flow of water to the spray plate 118 depending upon the orientation of the flow control plate 124 relative to the diverter plate 122.

In this embodiment, the flow control plate 124 has three transfer ports 152 that are uniformly spaced apart in the circumferential direction and the diverter plate 122 has nine transfer ports 154 that are uniformly spaced apart in the circumferential direction. The transfer ports 154 in the diverter plate 122 are arranged in three groups each comprising three ports 154 uniformly spaced apart in the circumferential direction so that the spacing of the ports 154 in each group corresponds to the spacing of the ports 152 in the flow control plate 124. The skilled person would understand that different numbers, sizes, shapes and configurations of transfer ports 152 and 154 may be employed.

Figure 7:
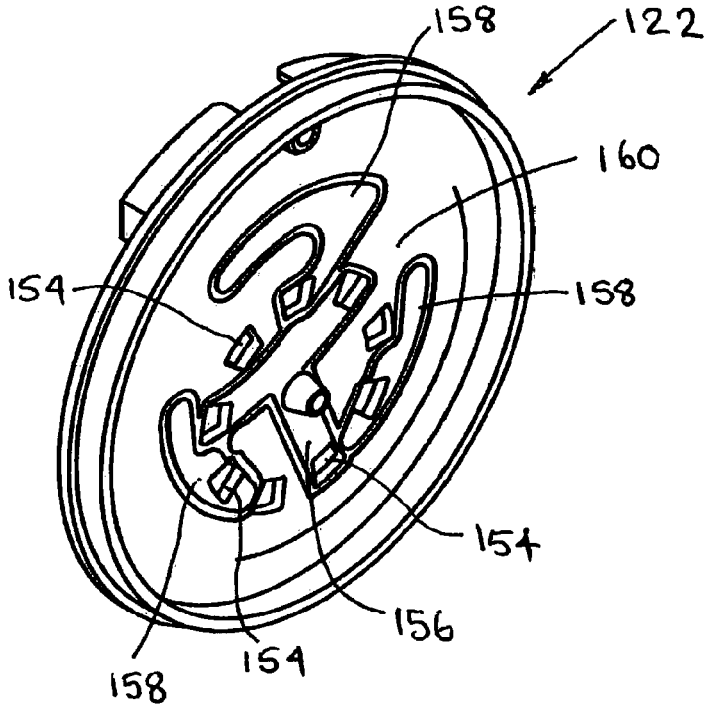
FIG. 7 shows a perspective view, to an enlarged scale, of the diverter plate of the spray control mechanism of the shower handset shown in FIGS. 1 to 4.

As shown in FIG. 7, a first group of three transfer ports 154 in the diverter plate 122 open into a diverter channel 156 on the downstream side of the sealing base 154. A second group of three transfer ports 154 in the diverter plate 122 open into respective diverter channels 158 on the downstream side of the diverter plate 122 separate from the diverter channel 156. A third group of three transfer ports 154 in the sealing base open into a diverter channel 160 created by the area on the downstream side of the diverter plate 122 separate from the diverter channels 156, 158. In the assembled spray cartridge 128, the baffle 120 co-operates with the diverter plate 122 to isolate the diverter channels 156, 158, 160 from each other.

Figure 8:
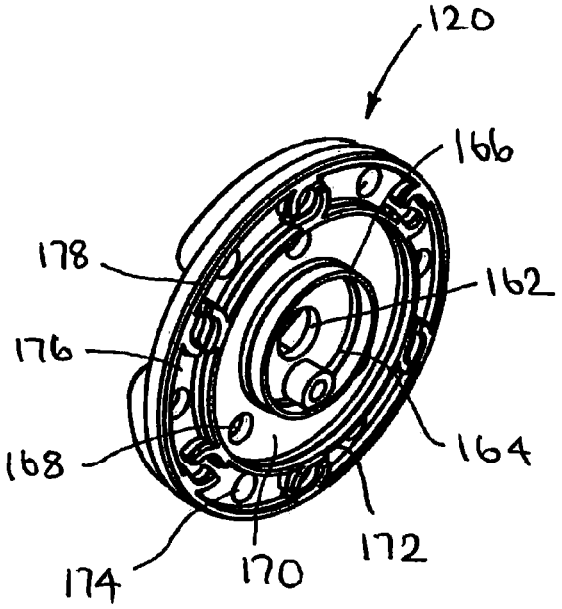
FIG. 8 shows a perspective view, to an enlarged scale, of the baffle of the spray control mechanism of the shower handset shown in FIGS. 1 to 4.

As shown in FIG. 8, the baffle 120 has a central opening or transfer port 162 that opens into a central chamber 164 defined by an annular wall 166 on the downstream side of the baffle 120. The port 162 connects the chamber 164 to the diverter channel 156 of the diverter plate 122. The central chamber 164 supplies the central hole 130 in the spray plate 118. The baffle 120 has a plurality of openings or transfer ports 168 that open into an annular channel 170 defined between the annular wall 166 and an intermediate annular wall 172 on the downstream side of the baffle 120. The ports 168 connect the channel 170 to the diverter channel 160 of the diverter plate 122. The channel 170 supplies the inner array 132*a* of the first set of holes 132 in the spray plate 118 and the channel 160 supplies the outer array 132*b* of the first set of holes 132 in the spray plate 118. The baffle 120 has a plurality of openings or transfer ports 174 that open into an annular channel 176 defined between the intermediate annular wall 172 and an outer annular wall 178 on the downstream side of the baffle 120. The ports 174 connect the channel 176 to the diverter channels 158 of the diverter plate 122. The channel 176 supplies the second set of holes 134 in the spray plate 118. In the assembled spray cartridge 128, the spray plate 118 co-operates with the baffle 120 to isolate the channels 170, 176 from each other and from the central chamber 164.

Figure 9:
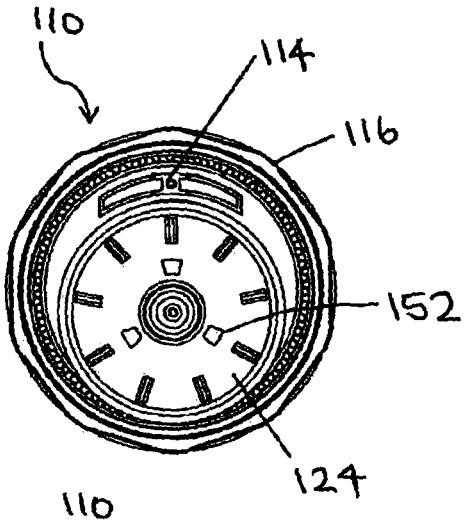
FIGS. 9, 10 and 11 show elements of the spray control mechanism of the shower handset shown in FIGS. 1 to 4 in a first position.
Figure 10:
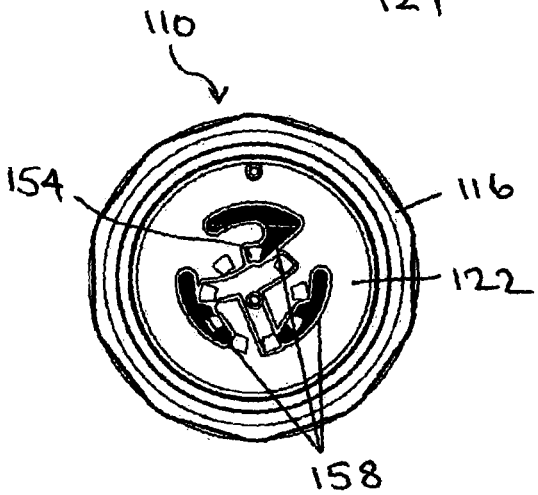
Figure 11:
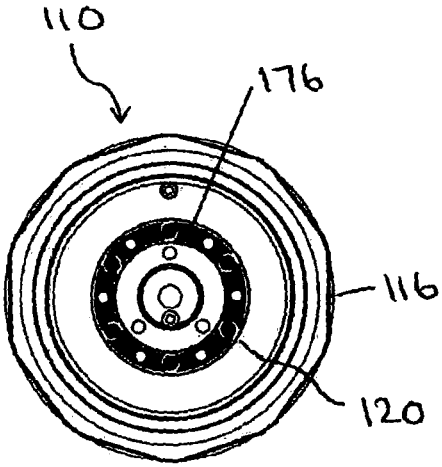
Figure 12:
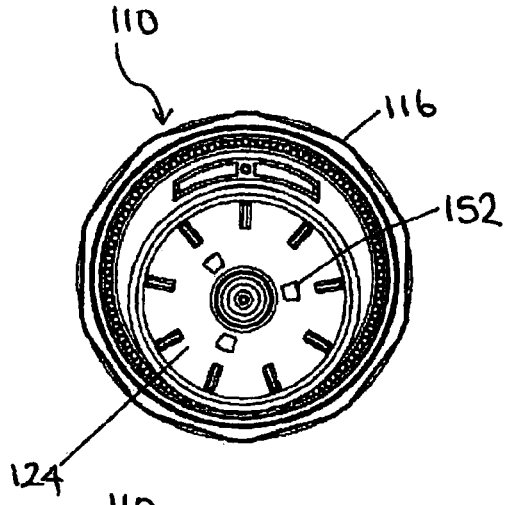
FIGS. 12, 13 and 14 show elements of the spray control mechanism of the shower handset shown in FIGS. 1 to 4 in a second position.
Figure 13:
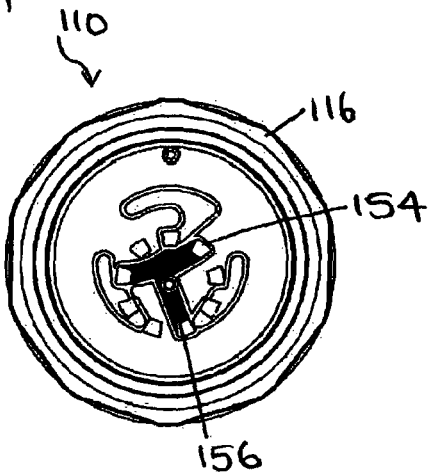
Figure 14:
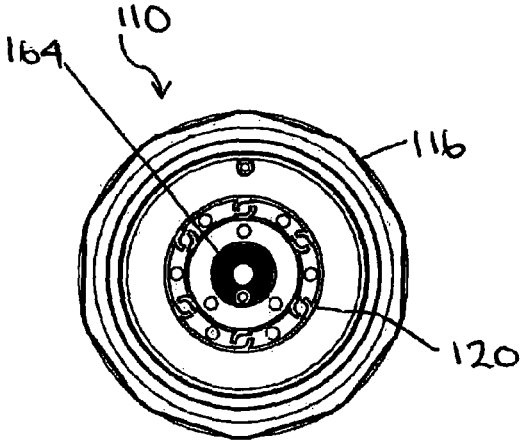
Figure 15:
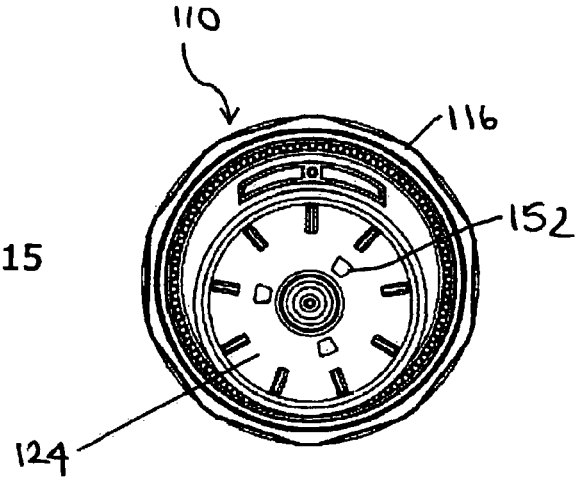
FIGS. 15, 16 and 17 show elements of the spray control mechanism of the shower handset shown in FIGS. 1 to 4 in a third position.
Figure 16:
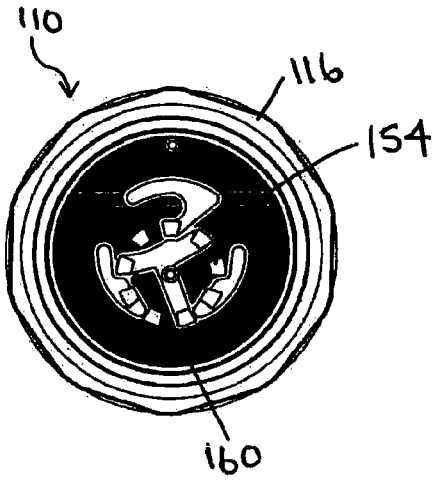
Figure 17:
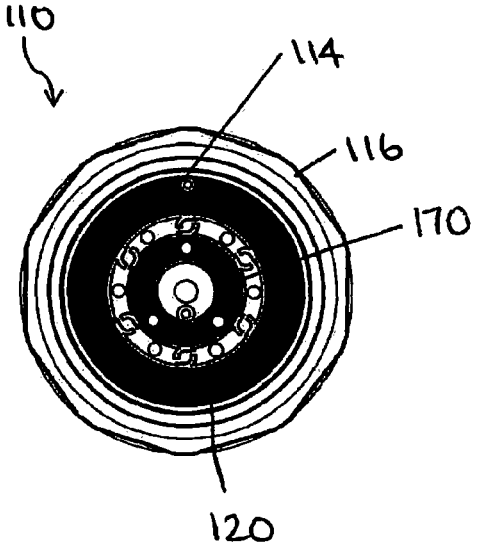

Operation of the spray assembly to select different spray modes will now be described with reference to FIGS. 9 to 17 wherein FIGS. 9 to 11 show a first spray mode, FIGS. 12 to 14 show a second spray mode and FIGS. 15 to 17 show a third spray mode. The water flow is shown in solid black in the drawings.

In the first spray mode shown in FIGS. 9 to 11, water is discharged through the second set of holes 134 in the spray plate 118 creating an annular spray pattern. In this mode, the transfer ports 152 in the flow control plate 124 align with the group of transfer ports 154 in the diverter plate 122 that open into the diverter channels 158 that in turn open into the annular channel 176 in the baffle 120.

In the second spray mode shown in FIGS. 12 to 14, water is discharged from the central hole 130 in the spray plate 118 creating a jet spray pattern. In this mode, the transfer ports 152 in the flow control plate 124 align with the group of transfer ports 154 in the diverter plate 122 that open into the diverter channel 156 that in turn opens into the central chamber 164 in the baffle 120.

In the third spray mode shown in FIGS. 15 to 17, water is discharged from the inner and outer arrays 132*a*, 132*b* of the first set of holes 132 in the spay plate 118 creating annular spray patterns. In this mode, the transfer ports 152 in the flow control plate 124 align with the group of transfer ports 154 in the diverter plate 122 that open into the diverter channel 160 that in turn opens into the annular channel 170 in the baffle 120 and the area surrounding the baffle 120.

To change from one spray mode to another spray mode, the control ring 116 is rotated to rotate the flow control plate 124 to move the transfer ports 152 from one group of transfer ports 154 in the diverter plate 122 to another group of transfer ports 154. In this embodiment, the control ring 116 can be rotated in either a clockwise direction or a counter-clockwise direction to change the spray mode. For example starting from the first spray mode, rotation in one direction may select the second spray mode followed by selection of the third spray on continued rotation in the same direction followed by selection of the first spray mode on continued rotation in the same direction and so on. Similarly starting from the first spray mode, rotation in the other direction may select the third spray mode followed by selection of the second spray on continued rotation in the same direction followed by selection of the first spray mode on continued rotation in the same direction and so on. The configuration of the transfer ports 152, 154 is such that changing from between spray modes corresponds to rotation of the control ring 116 through 40 degrees. Thus, for one complete rotation of the control ring 116, each spray mode can be selected three times. The skilled person would understand that the angular spacing between spray modes may be different in other embodiments.

Figure 18:
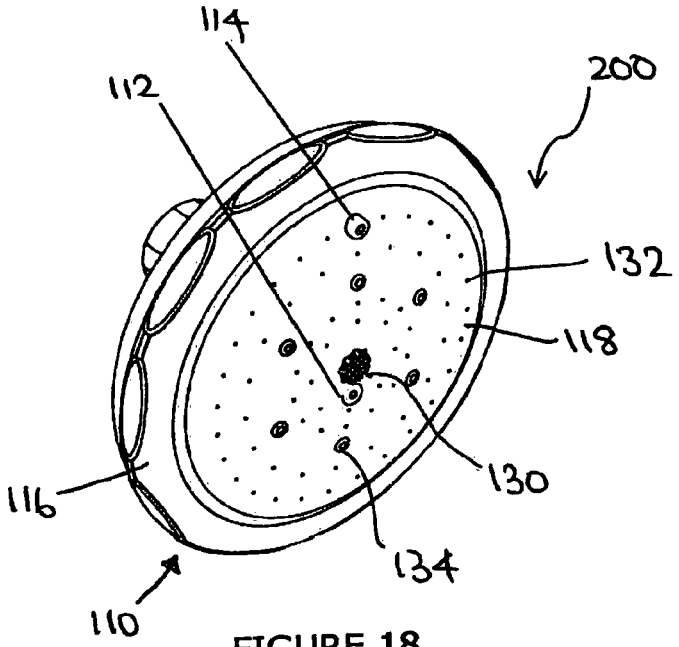
FIG. 18 shows a perspective view of a shower spray head according to another embodiment.
Figure 19:
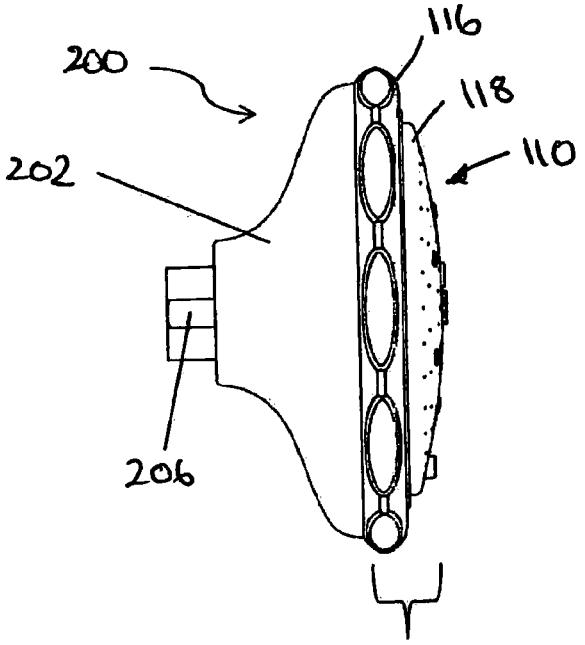
FIG. 19 shows a side view of the shower spray head shown in FIG. 18.

Referring now to FIGS. 18 and 19 of the accompanying drawings, the spray assembly 110 of the previous embodiment is shown in a fixed shower spray head 200 having a body 202 and a connector 206 for a water supply to the spray head 200. The construction and operation of the spray assembly 110 is the same as the previous embodiment and will be understood from the description of the previous embodiment.

Figure 20:
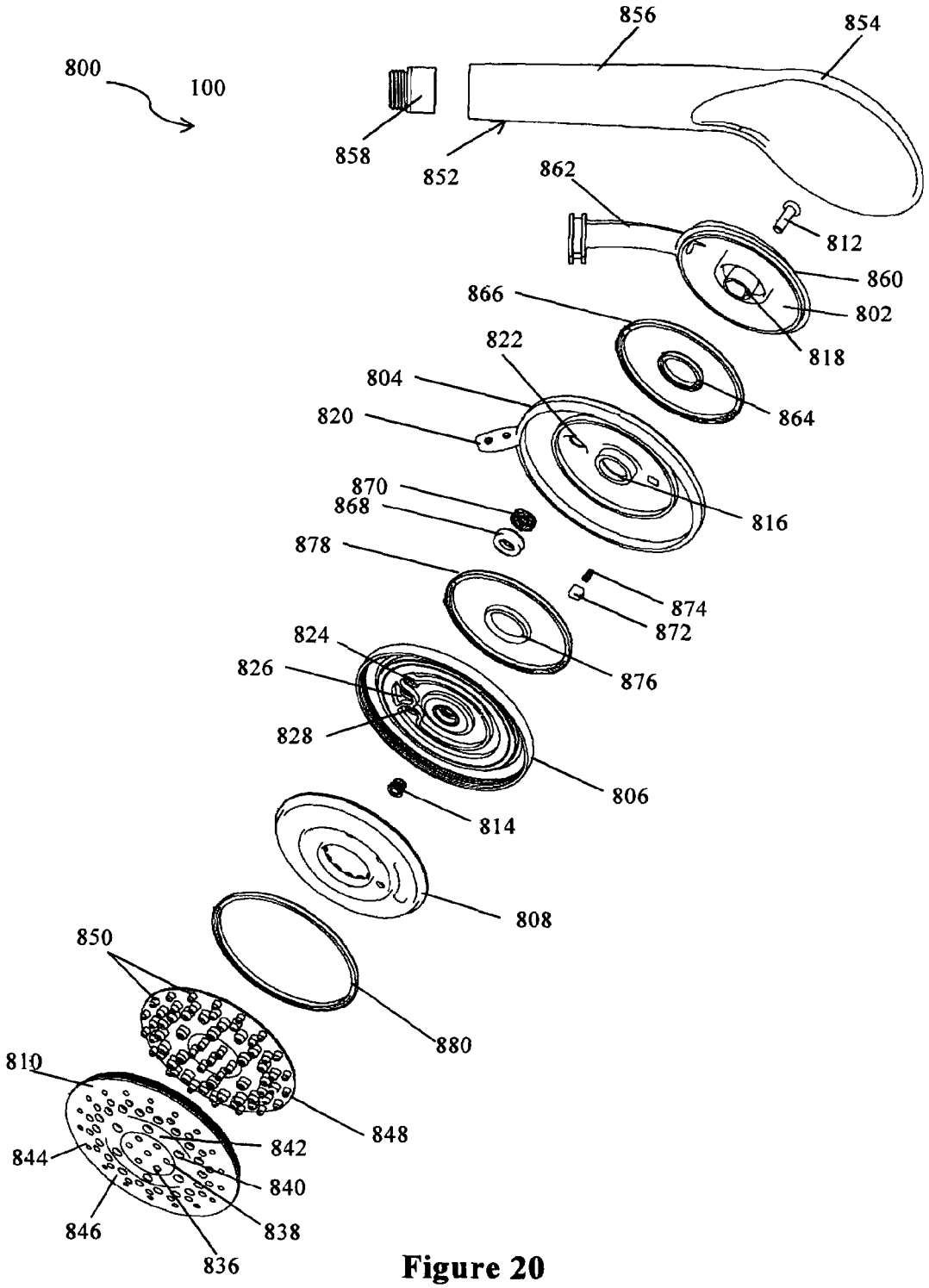
FIG. 20 shows an exploded view of a shower handset according to another embodiment.
Figure 21:
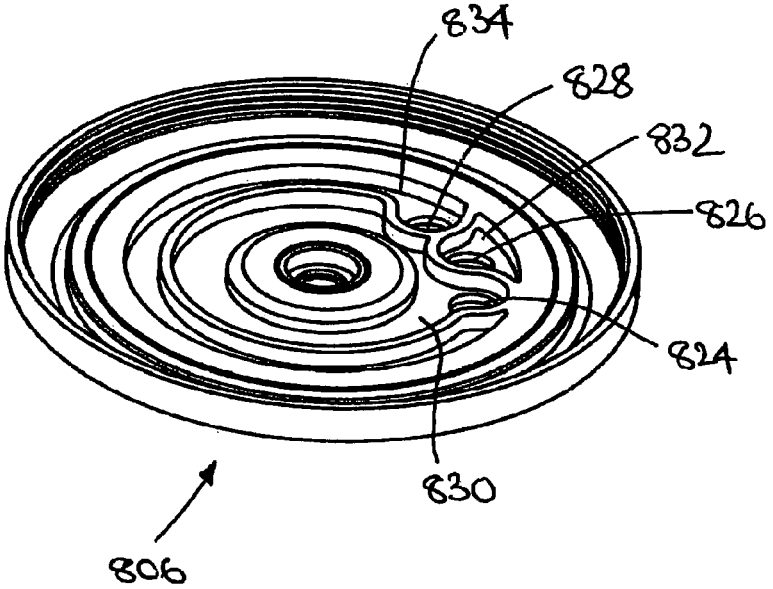
FIG. 21 shows a perspective view, to an enlarged scale, of the diverter plate of the spray control mechanism of the shower handset shown in FIG. 20.

Referring now to FIGS. 20 and 21, a shower handset 800 according to another embodiment of the invention is shown. The skilled person will appreciate that this embodiment could also be applied to a fixed shower spray head such as that shown in FIGS. 18 and 19.

In this embodiment the handset 800 is provided with a spray assembly that comprises a sealing base 802, a control member or ring 804, a diverter plate 806, a baffle 808 and a spray plate 810. The sealing base 802, control ring 804 and diverter plate 806 are secured together by a screw 812 inserted therethrough and engaging a threaded insert 814 seated in the diverter plate 806. The spray plate 810 is releasably secured to the diverter plate 806 and the baffle 808 is located therebetween. In some embodiments, the baffle 808 may be welded to the diverter plate 806. In this embodiment, the diverter plate 806 has threaded portions for securing the spray plate 810. The diverter plate 806 and baffle 808 may be provided as a single component in alternative embodiments.

The control ring 804 has a central opening 816 in which a central boss 818 of the sealing base 802 is received to locate the control ring 804 for rotation with respect to the sealing base 802 and diverter plate 806. The control ring 804 comprises an actuator portion 820 such as a tab, protrusion or lever extending from the circumference. A user may grip the actuator portion 820 to rotate the control ring 804 to select different spray modes as described later. The actuator portion 820 may be of a contrasting colour to assist identification by visually impaired users. The control ring 804 has a transfer port 822 offset from the central opening 816 for the passage of water. The actuator portion 820 may align with the transfer port 822. The spray plate 810 may be provided with markings and the actuator portion 820 may align with the markers to provide a visual indicator as to which spray mode has been selected. The markers may show on the spray plate 810 where the water flow will occur allowing the user to understand which holes will be in use when the actuator portion 820 is in different positions.

The diverter plate 806 has three transfer ports 824, 826 and 828. As shown in FIG. 21, the ports 824, 826, 828 open into respective diverter channels 830, 832, 834 on the downstream side of the diverter plate 806. The baffle 808 co-operates with the diverter plate 806 to isolate the channels 830, 832, 834 from each other. The baffle 808 is configured to connect each channel 830, 832, 834 to a different region of the spray plate 810 to change the spray mode.

In this embodiment, the spray plate 810 has a first set of holes 836 in an annular centre region 838 of the spray plate 810, a second set of holes 840 in an annular intermediate region 842 of the spray plate 810 surrounding the centre region 838, and a third set of holes 844 in an annular outer region 846 of the spray plate 810 surrounding the intermediate region 842. The baffle 808 connects channel 832 to the third set of holes 844, channel 830 to the first set of holes 836 and channel 834 to the second set of holes 840.

In this embodiment the spray plate 810 is overmolded on the upstream side with a mat 848 formed with nozzles 850 that are received in the holes 836, 840, 844 in the spray plate 810. The nozzles 850 project from the outer surface of the spray plate 810 and the mat 848 is formed of rubber or other elastomer that allows the nozzles 850 to be cleaned by a user rubbing their hand over the spray plate 810 to dislodge any limescale or other solid matter. The provision of rubber nozzles is not essential and the mat 848 may be omitted in other embodiments.

The handset 800 has a body 852 with a head portion 854 and a stem or grip portion 856 extending from the head portion 854. The grip portion 856 can be connected to a water source by a connector 858. The sealing base 802 has a head portion 860 and a tubular portion 862 extending from the head portion 860. The tubular portion 862 is received in the grip or stem portion 856 of the body 852 of the handset and the head portion 860 clips into the head portion 854 of the body 852 to secure the spray assembly to the handset 800.

The tubular portion 862 of the sealing base 802 and the transfer port 822 in the control ring 804 open to a region of the spray assembly between the sealing base 802 and the control ring 804 that is delimited by annular inner and outer lip seals 864, 866. The control ring 804 is provided with a bucket seal 868 and spring 870 that connects the transfer port 822 in the control ring 804 to the transfer ports 824, 826, 828 in the diverter plate 806 to control the flow of water to the spray plate 810 depending on the orientation of the control ring 804. The control ring 804 is also provided with a detent 872 and a spring 874 that biases the detent 872 to engage recesses (not shown) provided on the upstream side of the diverter plate 806 to locate the control ring 804 in each of three angularly spaced positions corresponding to different spray modes. The bucket seal 868 and spring 870, and the detent 872 and spring 874 are located in a region of the spray assembly that is delimited by annular inner and outer lips seals 876, 878. A lip seal 880 is also provided to seal between the spray plate 810 and the baffle 808.

Figure 22:
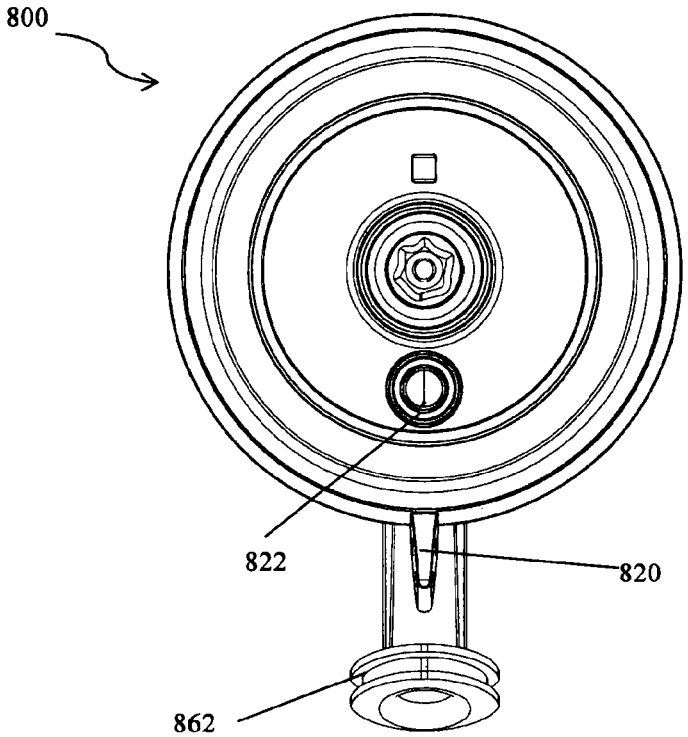
FIGS. 22 and 23 show elements of the spray control mechanism of the shower handset shown in FIG. 20 in a first position.
Figure 23:
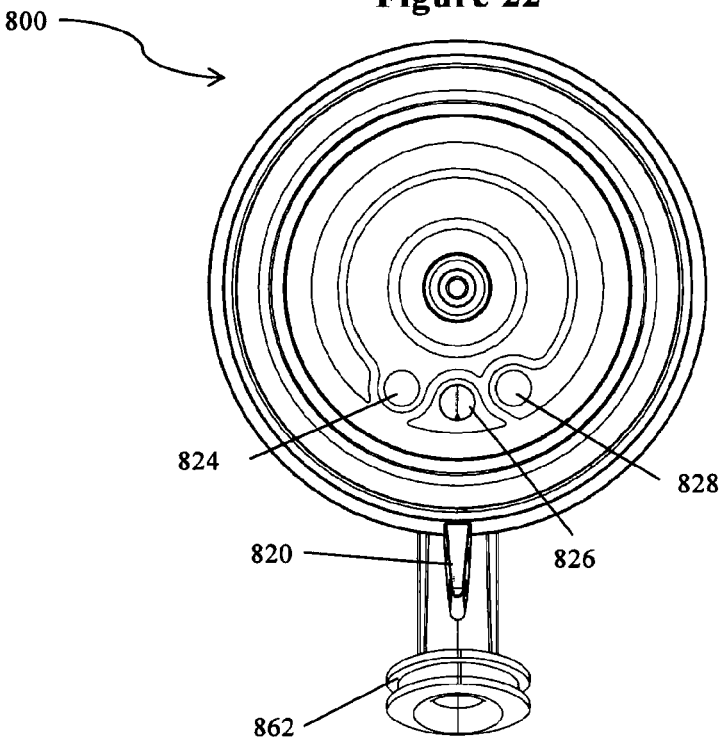
Figure 24:
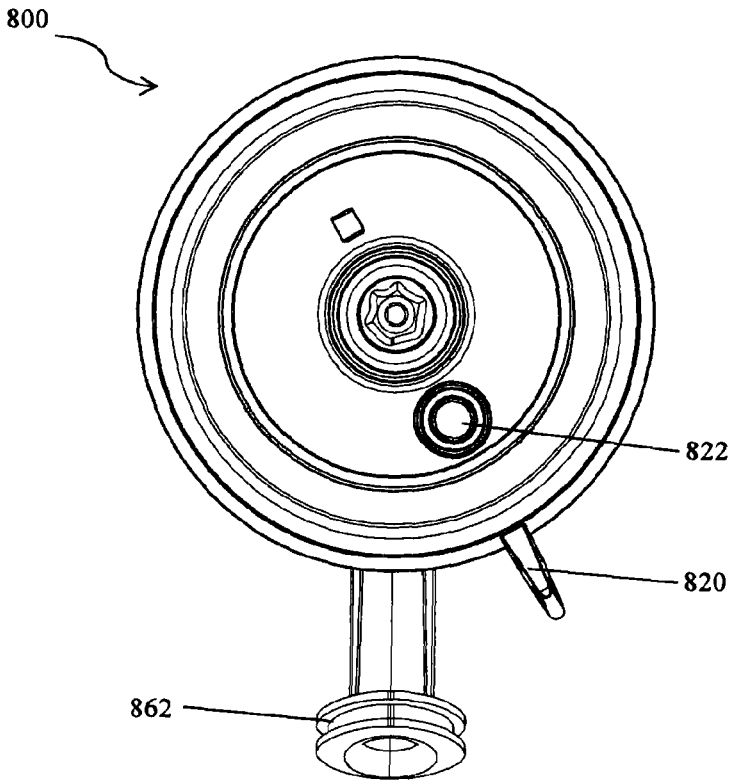
FIGS. 24 and 25 show elements of the spray control mechanism of the shower handset shown in FIG. 20 in a second position.
Figure 25:
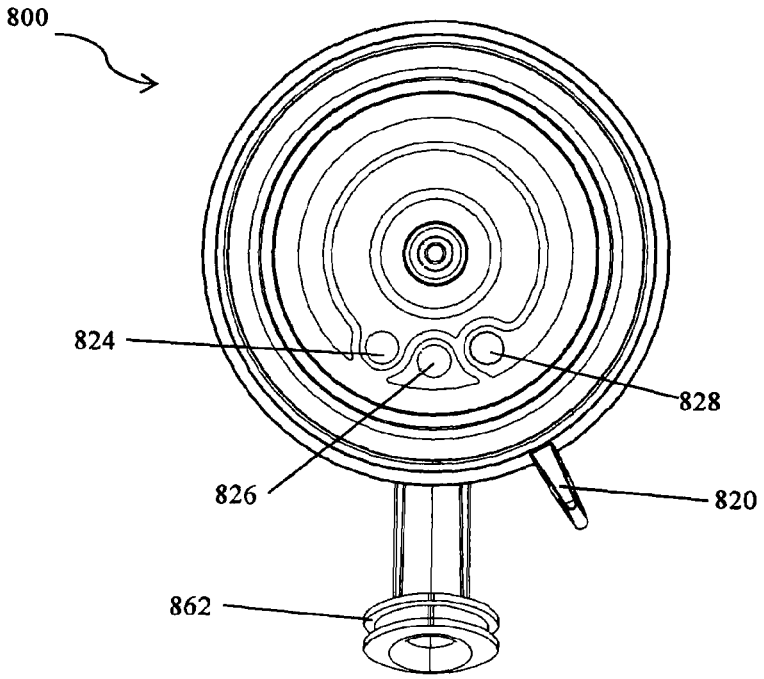
Figure 26:
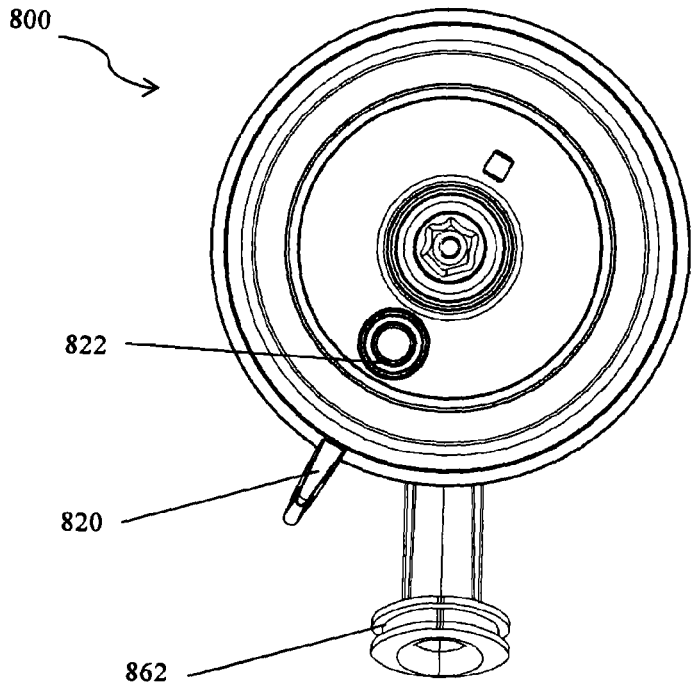
FIGS. 26 and 27 show elements of the spray control mechanism of the shower handset shown in FIG. 20 in a third position.
Figure 27:
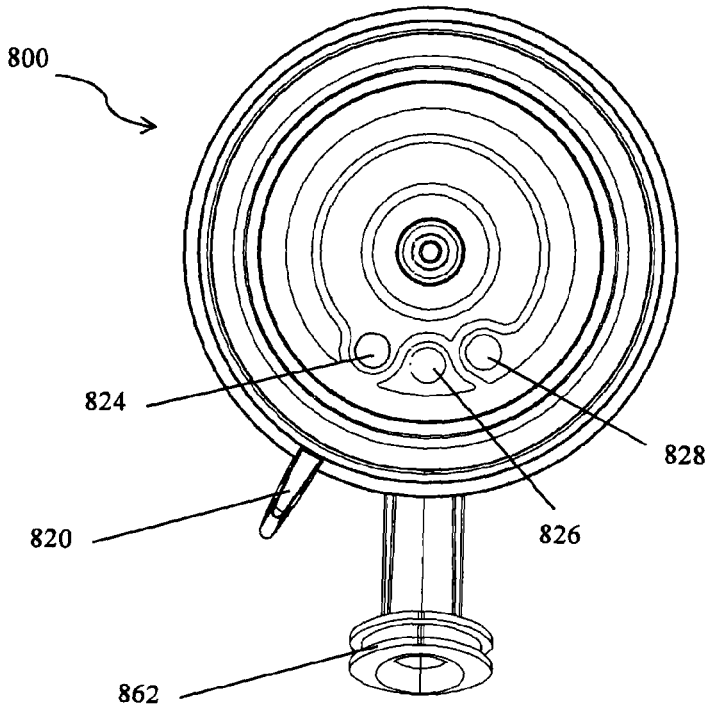

Operation of the spray assembly to select different spray modes will now be described with reference to FIGS. 22 to 27 wherein FIGS. 22 and 23 show a first spray mode, FIGS. 24 and 25 show a second spray mode and FIGS. 26 and 27 show a third spray mode.

In the first spray mode shown in FIGS. 22 and 23, water is discharged through the third set of holes 844 in the spray plate 810. In this mode, the transfer port 822 of the control ring 806 is connected to the transfer port 826 of the diverter plate 810 which opens to channel 832 that communicates with the third set of holes 844.

In the second spray mode shown in FIGS. 24 and 25, water is discharged through the second set of holes 840 in the spray plate 810. In this mode the transfer port 822 of the control ring 806 is connected to the transfer port 828 of the diverter plate 810 which opens to channel 834 that communicates with the second set of holes 840.

In the third spray mode shown in FIGS. 26 and 27, water is discharged through the first set of holes 836 in the spray plate 810. In this mode the transfer port 822 of the control ring 806 is connected to the transfer port 824 of the diverter plate 810 which opens to channel 830 that communicates with the first set of holes 836.

In the embodiment being described, the transfer ports 824, 826, 828 are angularly spaced around the diverter plate 806. Rotation of less than 45° is needed to move between all three transfer ports 824, 826, 828. In alternative embodiments, the angular spacing between the spray modes may be different.

In the embodiment being described, the spray plate 810 is screwed onto the diverter plate 806. The spray plate 810 may be removed and replaced to provide different spray patterns.

The skilled person would understand that the configurations described above are provided for explanatory purposes only, and are not intended to be limiting to the scope of the invention as claimed.

References herein to the positions of elements of the spray assembly are merely used to describe the orientation of various elements in the Figures. It should be noted that the orientation of various elements may differ according to other embodiments, and that such variations are intended to be encompassed by the present disclosure.

The construction and arrangement of the elements of the spray assembly as shown in the embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, any embodiment described herein is not necessarily to be construed as preferred or advantageous over other embodiments. Various embodiments are described and intended to present concepts in a concrete manner. Those skilled in the art will understand that substitutions, modifications, changes, and omissions may be made in the design, operating conditions, and arrangement of any embodiment without departing from the scope of the appended claims. For example, any element disclosed in one embodiment may be incorporated or utilized with any other embodiment disclosed herein. Also, for example, the order or sequence of any process or method or operation may be varied or re-sequenced according to alternative embodiments. Any means-plus-function clause is intended to cover the structures described herein as performing the recited function and not only structural equivalents but also equivalent structures.

The invention claimed is:

1. A spray assembly for a spray head arranged, in use, to adjust a spray pattern of fluid, comprising a spray plate with a plurality of holes therethrough, and a control member rotatable relative to the spray plate, wherein, in use, the orientation of the spray plate is fixed and rotation of the control member causes fluid to be directed to different groups of the plurality of holes through the spray plate, the spray assembly further comprising at least one flow control opening provided in a flow control plate, and arranged, in use, to be moved in response to rotation of the control member, and wherein the flow control plate has teeth all the way around its outer circumference, and the control member has teeth all the way around its inner circumference, and the teeth of the flow control plate are arranged to structurally cooperate either directly, or indirectly via an intermediate toothed component, with the teeth of the control member so as to drive the flow control plate when the control member is rotated.

2. The assembly according to claim 1, wherein the teeth on the outer circumference of the flow control plate interlock with the teeth on the inner circumference of the control member.

3. The assembly according to claim 1, wherein the teeth on the outer circumference of the flow control plate interlock with the teeth on the outer circumference of an idler gear, and wherein the teeth of the idler gear interlock with teeth on aft the inner circumference of the control member.

4. The assembly according to claim 1, further comprising a diverter plate having diverter channels associated with different groups of the plurality of holes of the spray plate.

5. The assembly according to claim 4, wherein the diverter channels communicate with the at least one flow control opening according to the position of the flow control plate or the control member, optionally wherein the at least one flow control opening is arranged to be moved between a plurality of discrete positions, and wherein the at least one flow control opening is arranged to align with a different one of the plurality of channels in each discrete position.

6. The assembly according to claim 4, wherein, in use, the orientation of the diverter plate is fixed with respect to the spray plate.

7. The assembly according to claim 4, wherein the diverter plate and spray plate are provided in the form of a detachable spray cartridge.

8. The assembly according to claim 4, wherein the spray plate is detachable from the diverter plate.

9. The assembly according to claim 1, wherein the control member comprises an annular ring, optionally wherein the ring extends around an outer perimeter of the assembly.

10. The assembly according to claim 9, wherein the ring is of a colour contrasting to a colour of an adjacent portion of the assembly.

11. The assembly according to claim 9, wherein the annular ring comprises rubber or a foamed polymer.

12. The assembly according to claim 9, wherein the control ring comprises one or more protrusions around its circumference.

13. The assembly according to claim 9, wherein the control ring has a textured surface around its circumference.

14. The assembly according to claim 9, wherein an axis of rotation of the flow control plate is offset from an axis of rotation of the annular ring of the control member.

15. A spray head comprising a spray assembly according to claim 1 arranged, in use, to adjust a spray pattern of fluid from the spray head.

16. The spray head according to claim 15 comprising a shower head.

17. The spray head according to claim 16, wherein the shower head comprises a shower handset or a fixed shower head.

18. A method of adjusting the spray pattern of fluid from a shower head comprising:

providing a shower head comprising a control member and a spray plate and at least one flow control opening provided in a flow control plate, and arranged, in use, to be moved in response to rotation of the control member, and wherein the flow control plate has teeth all the way around its outer circumference, and the control member has teeth all the way around its inner circumference, and the teeth of the flow control plate are arranged to structurally cooperate either directly, or indirectly via an intermediate toothed component, with the teeth of the control member so as to drive the flow control plate when the control member is rotated;

positioning the shower head adjacent to a surface; and moving the shower head relative to the surface such that the control member rotates by contact with the surface without rotating the spray plate.

* * * * *